United States Patent [19]

Hecht

[11] 4,346,137

[45] Aug. 24, 1982

[54] HIGH TEMPERATURE FATIGUE OXIDATION RESISTANT COATING ON SUPERALLOY SUBSTRATE

[75] Inventor: Ralph J. Hecht, North Palm Beach, Fla.

[73] Assignee: United Technologies Corporation, Hartford, Conn.

[21] Appl. No.: 105,358

[22] Filed: Dec. 19, 1979

[51] Int. Cl.[3] ..... B32B 15/04

[52] U.S. Cl. ..... 428/215; 428/469; 428/472; 428/926; 428/655; 428/667; 428/678; 428/615; 428/680; 428/653; 427/328; 427/405; 75/171; 75/170; 75/172 R

[58] Field of Search ..... 428/469, 472, 667, 678, 428/615, 680, 653, 926, 215; 427/328, 405; 148/31.5

[56] References Cited

U.S. PATENT DOCUMENTS

| | | | |
|---|---|---|---|
| 3,542,530 | 11/1970 | Talboom et al. | 428/926 X |
| 3,647,517 | 3/1972 | Milidantri et al. | 428/667 X |
| 3,676,085 | 7/1972 | Evans et al. | 427/250 X |
| 3,754,903 | 8/1973 | Goward et al. | 428/938 X |
| 3,819,338 | 6/1974 | Bungardt et al. | 428/678 X |
| 3,918,139 | 11/1975 | Felten | 428/655 |
| 3,928,026 | 12/1975 | Hecht | 428/926 X |
| 3,961,910 | 6/1976 | Baladjanian et al. | 428/923 X |
| 3,976,436 | 8/1976 | Chang et al. | 428/678 |
| 4,005,989 | 2/1977 | Preston | 428/628 X |
| 4,055,705 | 10/1977 | Stecura et al. | 428/667 X |
| 4,070,507 | 1/1978 | Stueber et al. | 427/252 |
| 4,109,061 | 8/1978 | Beale et al. | 428/678 |
| 4,123,594 | 10/1978 | Chang | 428/678 X |
| 4,123,595 | 10/1978 | Chang | 428/678 X |
| 4,129,167 | 12/1978 | Sigsbee | 428/668 X |

*Primary Examiner*—P. Ives

*Attorney, Agent, or Firm*—Charles E. Sohl

[57] ABSTRACT

An improved high temperature fatigue resistant coating for nickel and cobalt base superalloys having good oxidation and sulfidation resistance. The coating comprises by weight, 8–30% Co, 8–30% Cr, 5–20% Al, 10–60% Ni and 0.05–1.0% of a reactive metal selected from the group of Y, Sc, La and mixtures thereof, balance selected from the group consisting of Pt, Rh, and mixtures thereof, the (Pt+Rh) content being at least 13%.

6 Claims, 3 Drawing Figures

1st Vanes After 644 Hours of Engine Operation

NiCoCrAlY

PtNiCoCrAlY
60% Pt-5% Al

Aluminide
(Note Coating Defeat)

PtNiCoCrAlY
12% Pt - 10% Al

PtNiCoCrAlY
30% Pt - 8.5% Al

HIGH TEMPERATURE FATIGUE OXIDATION RESISTANT COATING ON SUPERALLOY SUBSTRATE

BACKGROUND OF THE INVENTION

This invention relates to the field of protective coatings for use on metallic parts which are used at elevated temperatures. This invention has particular utility in the field of gas turbine engines. It is conventional to use coatings on almost all gas turbine parts which encounter severe operating conditions at elevated temperatures. These parts include the burner assembly, turbine vanes and blades.

Perhaps the most advanced coatings now in use in gas turbine engines are those which are termed MCrAlY overlay coatings where M is a metal chosen from the group consisting of iron, nickel, cobalt and mixtures of nickel and cobalt, Cr is chromium, Al is aluminum and Y is yttrium or equivalent reactive metal. Typical of these MCrAlY coating alloys are those described in U.S. Pat. Nos. 3,542,530, 3,676,085, 3,754,903 and 3,928,026 which are all assigned to the assignee of the present invention. U.S. Pat. No. 3,918,139 which is also assigned to the present assignee describes an MCrAlY overlay coating which contains an addition of from three to twelve weight percent platinum or rhodium.

In the coating art, attempts have been made to employ platinum as a protective coating or a part of a protective coating system for gas turbine parts. U.S. Pat. No. 3,819,338 to Bungardt et al. suggests the use of platinum in a diffusion coating. According to this patent a layer of platinum is applied to the part to be protected followed by a conventional diffusion aluminizing treatment. In an alternative embodiment the platinum and aluminum are deposited simultaneously. A similar teaching is found in U.S. Pat. No. 3,961,910 to Baladjanian et al. In this patent the metal used is rhodium and a thin layer of rhodium is applied to the part to be protected followed by a conventional diffusion aluminzing coating. The rhodium layer is suggested to minimize the diffusion between the aluminide layer and the substrate which is being protected. U.S. Pat. No. 4,070,507 by Stueber et al. contains yet another teaching of the use of a platinum-rhodium layer prior to diffusion aluminiding. In this patent, a first coating of rhodium is applied followed by a second coating of platinum followed thereafter by a diffusion aluminizing treatment.

U.S. Pat. Nos. 3,976,436 and 4,018,569 (a division of U.S. Pat. No. 3,976,436) by Chang describe alloys and coatings based on MCrAlY coatings containing in addition from 0.1 to 10% hafnium and 0.5–20% of an element selected from the group consisting of platinum, rhodium and palladium. Suggested application techniques include diffusional coating techniques in combination with aluminiding. U.S. Pat. Nos. 4,123,594 and 4,123,595 both by Chang also relate to platinum containing protective coatings. These patents both describe coating systems including an inner graded coating which contains chromium, aluminum, hafnium and up to 30% platinum. An outer coating contains from 10 to 50% aluminum and 1 to 40% hafnium, platinum, rhodium or palladium in the case of U.S. Pat. No. 4,123,594 and 5 to 50% hafnium, platinum, rhodium, palladium in the case of U.S. Pat. No. 4,123,595. The method of coating application is a complex on in which after application of the first coating portion by vapor deposition the coated article is treated to cause substantial diffusion of the coating with the substrate after which the outer coating layer is applied through a process such as sputtering. In U.S. Pat. No. 4,123,594 the outer coating may also be applied by a pack deposition process.

SUMMARY OF THE INVENTION

Protective coating composition and coated article are disclosed. The coating composition is optimized to have a coefficient of thermal expansion which is close to that of typical superalloys. By minimizing the difference in coefficient of thermal expansion between the superalloy substrate and the coating, fatigue life is greatly increased. The broad composition range is 8–30% Co, 8–30% Cr, 5–20% Al, 10–60% Ni, 0.05–1.0% of a material selected from the group consisting of Y, Sc, La and mixtures thereof, balance selected from the group consisting of Pt, Rh and mixtures thereof in an amount of at least 13%. This coating is an overlay coating whose composition is independent of substrate composition and may be applied by sputtering or other vapor deposition method.

DESCRIPTION OF THE PREFERRED EMBODIMENTS

Protective coatings are widely used in modern gas turbine engines. The use of coatings permits the designer to specify structural materials of high strength without having to be particularly concerned with the surface stability of the materials in the destructive environment which exists within the gas turbine. Up to now, coatings have been regarded by many as working essentially independently of the substrate material. Thus, coatings have been developed based largely or only on their resistance to oxidation and corrosion and such coatings have been developed independently of their intended substrate application. However, it has been observed that in certain applications even the most oxidation resistant coatings failed well in advance of their expected life. Often such failures were observed to be the result of fatigue cracks. Fatigue failure is the result of the application of fluctuating stresses over a long period of time. In the case of a coated article, the stresses result from the difference in the coefficient of thermal expansion between the substrate material and the coating material. This difference in the coefficient of expansion results in the coating being stressed by the substrate during thermal cycling.

Figure 1:
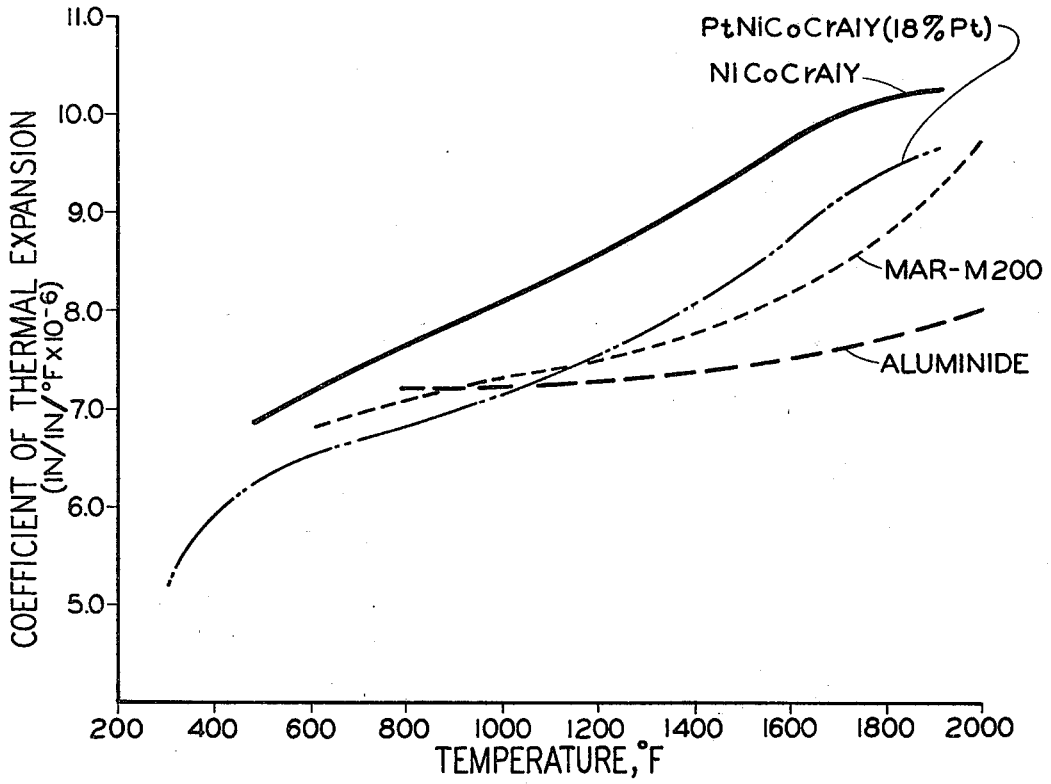
FIG. 1 shows the coefficient of thermal expansion of a variety of coating materials and a typical superalloy substrate material.

The present invention coating deals with the problem of thermal expansion by reducing the coefficient thermal expansion of the coating so that it approaches the coefficient of thermal expansion of typical substrate materials. This is illustrated in FIG. 1 which shows the coefficient of thermal expansion, as a function of temperature, of several different coatings and one commonly used substrate material. The curve aluminide shows the coefficient of thermal expansion for a typical aluminide protective coating. The curve labeled Ni- CoCrAlY shows the coefficient of thermal expansion for an overlay coating material containing nominally 23% cobalt, 18% chromium, 12.5% aluminum and 0.3% yttrium, balance nickel. The curve labeled PtNiCoCrAlY shows the coefficient of thermal expansion for the same NiCoCrAlY composition previously described but with the homogeneous addition of 18% platinum (by homogeneous addition, I mean that 18% Pt is added to 82% of the nominal coating composition). The curve labeled MAR-M-200 shows the coefficient of thermal expansion for an alloy containing (nominally) 9% chrome, 10% cobalt, 12.5% tungsten, 1% colombium, 2% titanium, 5% aluminum, 1.5% hafnium, 0.015% boron, 0.05% zirconium, 0.15% carbon, balance nickel. From FIG. 1, it can be seen that the aluminide coating has a coefficient of thermal expansion which is generally less than that of the substrate material while the NiCrCoAlY overlay coating composition has a coefficient of thermal expansion which is substantially greater than that of the substrate material. The addition of 18% platinum to the NiCoCrAlY composition reduces the coefficient of thermal expansion to the point where it more closely approaches the coefficient of thermal expansion of the substrate material.

Mechanical property testing has demonstrated that the addition of up to about 60% Pt to MCrAlY coatings does not significantly affect the elevated temperature ductility of the coating alloy.

Similarly in cyclic oxidation tests at 2175° F., variety of Pt levels in NiCoCrAly (17–36% Pt) showed oxidation behavior at least as good as, and in some cases superior to, the oxidation behavior of platinum free NiCoCrAlY.

In hot corrosion testing employing a 1750° F./3 min+2050° F./2 min+2 min forced air cool cyclic test in a hot gas stream containing 35 ppm of synthetic sea salt, PtNiCoCrAlY (with 24% pt) showed a 350% life improvement in comparison with conventional aluminide coatings and performance slightly better than platinum free NiCoCrAlY.

Based on these results it appears that platinum improves coating fatigue life without adversely affecting any other important coating properties.

Figure 2:
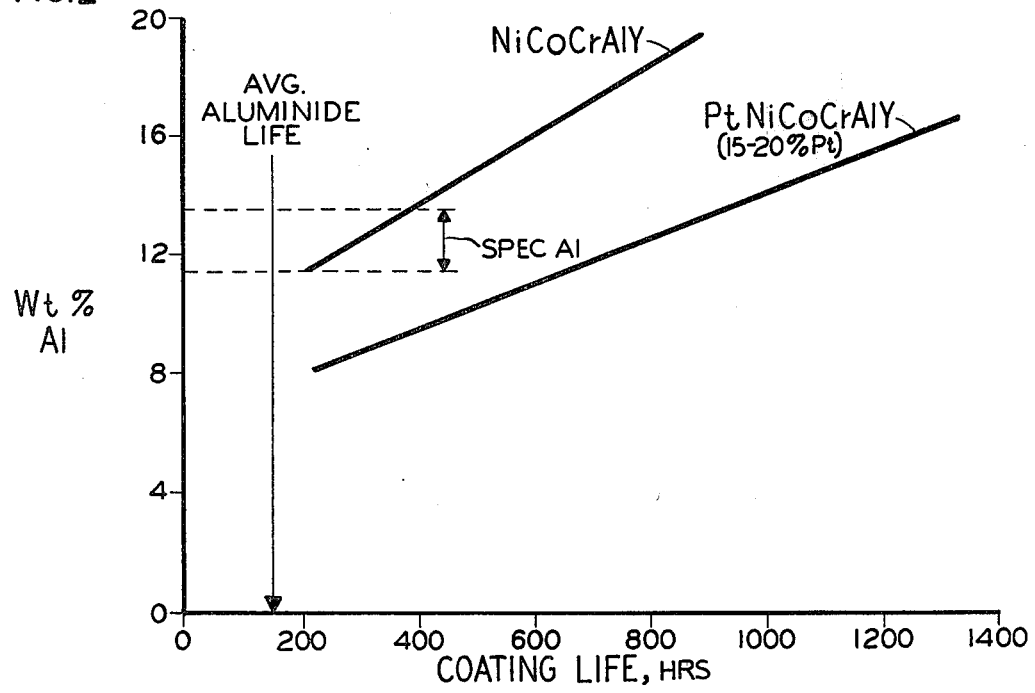
FIG. 2 shows cyclic oxidation behavior of several coating compositions as a function of aluminum content.
Figure 3:
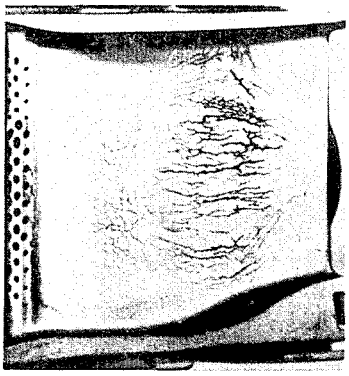
FIG. 3 shows the surface condition of several vanes, coated with different coatings, after an engine test.
Figure 3:
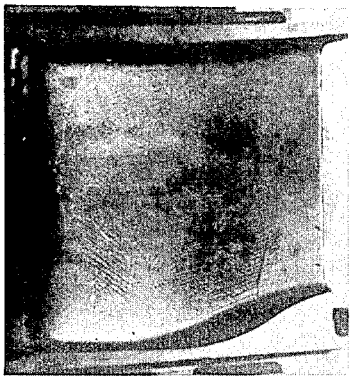
Figure 3:
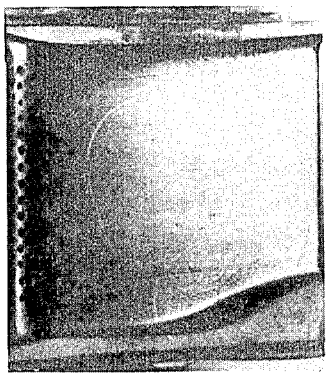
Figure 3:
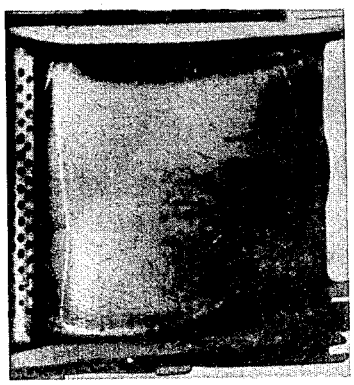
Figure 3:
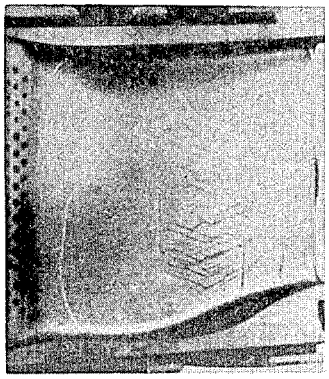

FIG. 2 shows the beneficial effect of platinum additions from about 15% to about 20% on the cyclic oxidation behavior of a NiCoCrAlY coating. Both overlay coatings and aluminide coatings offer protection as a result of the formation of an aluminum oxide layer on the coating surface. This layer spalls off during use and is replaced by the oxidation of aluminum contained within the coating. Thus, coating behavior is strongly affected by the aluminum content of the coating. FIG. 2 shows the coating life of several coatings as a function of their aluminum content. The curve labeled NiCoCrAlY is for the previously described coating composition with varying aluminum contents. The dotted lines on the curve indicate limits for a particular NiCoCrAlY composition of from about 11½ to 13½% aluminum. Within this range the NiCoCrAlY coating life is seen to be about 300 hours. The homogeneous addition of from about 15 to about 20% platinum to this same nominal NiCoCrAlY composition is seen to improve the coating life to a point slightly in excess of about 600 hours. These overlay coating lives can be compared with the typical aluminide coating life of somewhat less than 200 hours. Thus, the addition of between 15 and 20% platinum is seen to more than double the coating life. This improvement in coating life is attributed in large measure to the improved fatigue properties due to the decrease in the difference of coefficient of thermal expansion between the coating composition and the substrate composition.

Based on these and other test results the following composition ranges have been formulated for the coating of the present invention. The coating contains from 8 to 30% cobalt, from 8 to 30% chromium, from 10 to 60% nickel, from 5 to 20% aluminum, from 0.01 to 1% yttrium, balance selected from the group consisting of platinum, palladium and rhodium and mixtures thereof provided that the content of this last described platinum group metal be at least 13%, preferably at least 17%, and most preferably, at least 21%. Because of the high cost of platinum, palladium and rhodium, it is preferred that this coating be applied by sputtering because of the high efficiency of sputtering in terms of the amount of starting material which is eventually deposited on the article to be protected. A typical sputtering apparatus which is suited for use in depositing the present coating composition on gas turbine airfoils is shown in U.S. Pat. No. 4,090,941 the contents of which are incorporated herein by reference. Using this patented apparatus, one may either use a homogeneous PtMCrAlY target or the Pt may be incorporated in separate electrodes. By using separate Pt electrodes (in conjunction with a separate electrical power supply), close control may be obtained over the Pt deposition rate.

As previously indicated, aluminum plays a crucial role in the development of the protective oxide scale which is essential to the proper functioning of a gas turbine overlay coating. Thus, if oxidation were the only problem, high aluminum contents would be desirable. However, high aluminum contents reduce coating ductility. Thus, the choice of the particular aluminum content for an application depends upon the relative severity of the oxidation conditions and the thermal strains which the coating will encounter. Chromium plays a vital role in protecting the coated article against hot corrosion in the moderate temperature range, that is from about 1200° to about 1600° F. If corrosion problems are anticipated in this temperature range, high chromium levels are preferred. With regard to cobalt content, high cobalt levels are preferred for the higher temperature gas turbine engines which are used in aircraft applications while lower cobalt concentrations are generally preferred for the lower temperature industrial gas turbines. In addition, if the coating is to be applied to nickel base superalloy, lower cobalt concentrations are preferred for diffusional stability while if the coating is to be applied to a cobalt base superalloy a higher cobalt coating concentration would be preferred. As previously indicated the platinum content plays a major role in controlling the coefficient of thermal expansion on the coating. In general, higher platinum contents are preferred where low coefficients of thermal expansion are desired. As has been previously indicated from 0.01 to 1% yttrium is desired in a coating alloy. This yttrium may be substituted in whole or in part by another oxygen active element chosen from the group consisting of hafnium, lanthanum and scandium. The oxygen active element acts to improve the oxide adherence by forming internal oxides which are connected to the surface oxide and which help to anchor the surface oxide to the MCrAlY layer. It is preferred that this element be present in amounts in excess of 0.1%. In addition to the previously numerated elements up to 5 weight percent of the material selected from the group consisting of silicon, hafnium and magnesium may be added for improved coating performance, and the use of such elements will largely depend upon the particular coating application.

The present invention may be better understood through reference to the following example which is meant to be illustrative rather than limiting.

EXAMPLE

Several coating compositions were evaluated by actual engine test in an advanced military jet engine. Coatings were evaluated by application to the first stage vanes (pressure side). These vanes endure severe conditions since they are located immediately downstream of the combustion chamber.

The various coating compositions evaluated are listed below in Table 1. These coating compositions are the approximate result of the homogeneous additions of the indicated platinum contents to NiCoCrAlY composition containing 13% Al, 10% Co, 17% Cr (the Y level was held constant at 0.1%).

TABLE I

1ST VANES - EXPERIMENTAL COATINGS

| OVERLAY | NOMINAL COATING COMPOSITION (WT %) | | | | | |
|---|---|---|---|---|---|---|
| THICKNESS (MILS) | Pt | Al | Ni | Co | Cr | Y |
| 1. 3.0 | 60 | 5 | Bal | 5 | 7 | .1 |
| 2. 3.5 | 30 | 8.5 | Bal | 7 | 11 | .1 |
| 3. 4.0 | 12 | 10 | Bal | 9 | 15 | .1 |
| 4. 5.0 | 0 | 13 | Bal | 10 | 17 | .1 |
| 5. Aluminide Coating | | | | | | |

These compositions were applied to vanes made of MAR-M-200, a superalloy whose nominal composition is 9Cr, 10Co, 12.5W, 1Cb, 2Ti, 5Al, 0.015B, 0.05Zr, 0.15C, balance Ni. Coatings were applied by sputtering except the aluminide coating which was applied by a conventional pack deposition process. The coated vanes were installed in the engine for evaluation. After 180.6 hours of operation the vanes were removed for inspection. Cracking was noted in coatings 4 and 5. All of the platinum containing coatings were crack free. After inspection the parts were reinstalled and run for an additional 463.3 hours (643.9 hours total). At the end of this time the blades were again inspected. FIG. 2 shows the condition of the blades after light surface cleaning.

Cracks are apparent in coatings #2 through #5. In the case of coating #1 (60% Pt) two or three very small cracks may be discerned. It is evident that conventional coatings 4 and 5 show the worst cracking problems and that increasing the Pt level decreases the incidence of cracking. These cracks are attributable to thermal fatigue caused by a difference in coefficient of thermal expansion between the blade material and the coating. Since it has been demonstrated (FIG. 1) that increasing platinum additions decreases the mismatch in thermal coefficient of expansion it is not unexpected that increasing platinum levels results in reduced levels of cracking.

This example clearly demonstrates the practical value of the present invention coatings in a real application where severe conditions are encountered.

Although this invention has been shown and described with respect to a preferred embodiment, it will be understood by those skilled in this art that various changes in form and detail thereof may be made without departing from the spirit and scope of the claimed invention.

Having thus described a typical embodiment of my invention, that which I claim as new and desire to secure by Letters Patent of the United States is:

1. A coated article consisting of a superalloy substrate having a protective coating on at least part of the substrate, said coating consisting essentially of 8–30% Cr, 5–20% Al, 10–60% Ni, 8–30% Co, from 0.05–1.0% of a material selected from the group consisting of Y, Sc, and La, and mixtures thereof, balance Pt, Rh and mixtures thereof in an amount of at least 13%.

2. A coated article as in claim 1 in which the coating further contains up to 5% of a material selected from the group consisting of Si, Hf, Mg and mixtures thereof.

3. A coated article as in claim 1 in which the coating thickness is from 1 to 10 mils.

4. A coated article as in claim 1 which further includes an aluminide interlayer between the substrate and the protective coating.

5. A coated article as in claim 1 in which the (Pt+Rh) content excedes 17%.

6. A coated article as in claim 1 in which the (Pt+Rh) content excedes 21%.

* * * * *